US009669618B2

(12) United States Patent
Bamberg et al.

(10) Patent No.: US 9,669,618 B2
(45) Date of Patent: Jun. 6, 2017

(54) INK-JET TRANSFER SYSTEM FOR DARK TEXTILE SUBSTRATES

(71) Applicant: Arkwright Advanced Coating, Inc., Fiskeville, RI (US)

(72) Inventors: Ulf Bamberg, Jestetten (DE); Peter Kummer, Neunkirch (CH); Ilona Stiburek, Zurich (CH)

(73) Assignee: ARKWRIGHT ADVANCED COATING, INC., Fiskeville, RI (US)

( * ) Notice: Subject to any disclaimer, the term of this patent is extended or adjusted under 35 U.S.C. 154(b) by 0 days.

(21) Appl. No.: 14/272,647

(22) Filed: May 8, 2014

(65) Prior Publication Data

US 2014/0240420 A1 Aug. 28, 2014

Related U.S. Application Data

(60) Continuation of application No. 13/286,856, filed on Nov. 1, 2011, now abandoned, which is a continuation of application No. 12/977,555, filed on Dec. 23, 2010, now abandoned, which is a division of application No. 09/980,466, filed as application No. PCT/IB99/00976 on Jun. 1, 1999, now Pat. No. 7,943,214.

(51) Int. Cl.

| | |
|---|---|
| ***B41J 2/005*** | (2006.01) |
| ***B41M 5/025*** | (2006.01) |
| ***B41M 5/50*** | (2006.01) |
| ***B44C 1/17*** | (2006.01) |
| ***D06P 5/24*** | (2006.01) |
| ***D06P 5/30*** | (2006.01) |
| ***D06Q 1/12*** | (2006.01) |
| *B41M 5/52* | (2006.01) |

(52) U.S. Cl.

CPC ..... *B41J 2/0057* (2013.01); *B41M 5/0256* (2013.01); *B41M 5/502* (2013.01); *B41M 5/506* (2013.01); *B44C 1/1716* (2013.01); *D06P 5/003* (2013.01); *D06P 5/007* (2013.01); *D06P 5/30* (2013.01); *D06Q 1/12* (2013.01); *B41M 5/508* (2013.01); *B41M 5/52* (2013.01)

(58) Field of Classification Search

CPC ..... B44C 1/1712; B41J 2/005

See application file for complete search history.

(56) References Cited

U.S. PATENT DOCUMENTS

| | | | |
|---|---|---|---|
| 4,224,358 | A | 9/1980 | Hare |
| 4,284,456 | A | 8/1981 | Hare |
| 4,863,781 | A | 9/1989 | Kronzer |
| 4,966,815 | A | 10/1990 | Hare |
| 4,980,224 | A | 12/1990 | Hare |
| 5,096,475 | A | 3/1992 | Kasper et al. |
| 5,139,917 | A | 8/1992 | Hare |
| 5,236,801 | A | 8/1993 | Hare |
| 5,242,739 | A | 9/1993 | Kronzer et al. |
| 5,271,990 | A | 12/1993 | Kronzer et al. |
| 5,272,979 | A | 12/1993 | Lewis et al. |
| 5,372,884 | A | 12/1994 | Abe et al. |
| 5,501,902 | A | 3/1996 | Kronzer |
| 5,521,229 | A | 5/1996 | Lu et al. |
| 5,529,408 | A | 6/1996 | Moriguchi et al. |
| 5,576,264 | A | 11/1996 | Ueno et al. |
| 5,620,548 | A | 4/1997 | Hare |
| 5,665,476 | A | 9/1997 | Oez |
| 5,747,148 | A | 5/1998 | Warner et al. |
| 5,792,579 | A | 8/1998 | Phillips |
| 5,798,179 | A | 8/1998 | Kronzer |
| 5,833,790 | A | 11/1998 | Hare |
| 5,908,723 | A | 6/1999 | Malhotra et al. |
| 5,908,728 | A | 6/1999 | Sakaki et al. |
| 5,925,712 | A | 7/1999 | Kronzer |
| 5,948,586 | A | 9/1999 | Hare |
| 5,962,149 | A | 10/1999 | Kronzer |
| 6,017,611 | A | 1/2000 | Cheng et al. |
| 6,033,739 | A | 3/2000 | Kronzer |
| 6,033,824 | A | 3/2000 | Hare et al. |
| 6,036,808 | A | 3/2000 | Shaw-Klein et al. |
| 6,083,656 | A | 7/2000 | Hare et al. |
| 6,087,061 | A | 7/2000 | Hare et al. |

(Continued)

FOREIGN PATENT DOCUMENTS

| | | | |
|---|---|---|---|
| DE | 19628341 | A1 | 1/1998 |
| EP | 0466503 | A1 | 1/1992 |
| EP | 0782931 | A1 | 7/1997 |
| EP | 0881092 | A2 | 12/1998 |
| EP | 0899121 | A1 | 3/1999 |
| EP | 0933225 | A1 | 8/1999 |
| GB | 2295973 | A | 6/1996 |
| JP | 63122592 | A | 5/1988 |
| JP | 1037233 | A | 2/1989 |
| JP | 7276833 | A | 10/1995 |
| JP | 8085269 | A | 4/1996 |
| WO | 9733763 | A2 | 9/1997 |
| WO | 9830749 | A1 | 7/1998 |
| WO | 0015445 | A1 | 3/2000 |
| WO | 0073570 | A1 | 12/2000 |

OTHER PUBLICATIONS

Office Action for U.S. Appl. No. 13/177,284 filed Jul. 6, 2011 in the name of Bamberg, dated Jun. 21, 2012.

(Continued)

*Primary Examiner* — Betelhem Shewareged

(74) *Attorney, Agent, or Firm* — Barlow, Josephs & Holmes, Ltd.

(57) ABSTRACT

An ink-jet transfer system is disclosed, as well as a transfer printed product which is highly wash-resistant, color-fast and environment-friendly, and a process for producing the same and its use in a printing process by means of the disclosed ink-jet transfer system. The disclosed ink-jet transfer system has a substrate, a hot-melt layer applied on the substrate and at least one ink-absorbing layer which comprises a mixture of a highly porous pigment and a binder. The molecules of the pigment and if required of the binder and hot-melt layer can form chemical bonds with the dyeing molecules of the ink.

19 Claims, No Drawings

(56) References Cited

U.S. PATENT DOCUMENTS

| | | | |
|---|---|---|---|
| 6,090,520 | A | 7/2000 | Hare et al. |
| 6,113,725 | A | 9/2000 | Kronzer |
| 6,139,672 | A | 10/2000 | Sato et al. |
| 6,177,187 | B1 | 1/2001 | Niemoller et al. |
| 6,200,668 | B1 | 3/2001 | Kronzer |
| 6,242,082 | B1 | 6/2001 | Mukoyoshi et al. |
| 6,245,710 | B1 | 6/2001 | Hare et al. |
| 6,258,448 | B1 | 7/2001 | Hare |
| 6,265,128 | B1 | 7/2001 | Hare et al. |
| 6,331,374 | B1 | 12/2001 | Hare et al. |
| 6,338,932 | B2 | 1/2002 | Hare et al. |
| 6,340,550 | B2 | 1/2002 | Hare et al. |
| 6,383,710 | B2 | 5/2002 | Hare et al. |
| 6,423,466 | B2 | 7/2002 | Hare et al. |
| 6,428,878 | B1 | 8/2002 | Kronzer |
| 6,450,633 | B1 | 9/2002 | Kronzer |
| 6,495,241 | B2 | 12/2002 | Sato et al. |
| 6,497,781 | B1 | 12/2002 | Dalvey et al. |
| 6,509,131 | B2 | 1/2003 | Hare et al. |
| 6,551,692 | B1 | 4/2003 | Dalvey et al. |
| 6,638,604 | B1 | 10/2003 | Bamberg et al. |
| 6,638,682 | B2 | 10/2003 | Hare et al. |
| 6,667,093 | B2 | 12/2003 | Yuan et al. |
| 6,884,311 | B1 | 4/2005 | Dalvey et al. |
| 7,744,475 | B2 | 6/2010 | Vrana et al. |
| 7,749,581 | B2 | 7/2010 | Dalvey et al. |
| 7,754,042 | B2 | 7/2010 | Dalvey et al. |
| 7,766,475 | B2 | 8/2010 | Dalvey et al. |
| 7,771,554 | B2 | 8/2010 | Dalvey et al. |
| RE41,623 | E | 9/2010 | Schwendimann et al. |
| 7,824,748 | B2 | 11/2010 | Dalvey et al. |
| RE42,541 | E | 7/2011 | Dalvey et al. |
| 8,197,918 | B2 | 6/2012 | Dalvey et al. |
| 2001/0051265 | A1 | 12/2001 | Williams et al. |
| 2002/0025208 | A1 | 2/2002 | Sato et al. |
| 2002/0048656 | A1 | 4/2002 | Sato et al. |
| 2002/0064616 | A1* | 5/2002 | Sawatsky ..... A47G 19/00 428/35.7 |
| 2002/0192434 | A1 | 12/2002 | Yuan et al. |
| 2005/0048230 | A1 | 3/2005 | Dalvey et al. |
| 2008/0149263 | A1 | 6/2008 | Dalvey et al. |
| 2010/0323132 | A1 | 12/2010 | Dalvey et al. |

OTHER PUBLICATIONS

Office Action for U.S. Appl. No. 13/182,197 filed Jul. 13, 2011 in the name of Bamberg, dated Jul. 11, 2012.

Office Action for U.S. Appl. No. 13/196,624 filed Aug. 2, 2011 in the name of Bamberg, dated Jun. 19, 2012.

Office Action for U.S. Appl. No. 13/223,541 filed Sep. 1, 2011 in the name of Bamberg, dated Oct. 4, 2012.

USDC-District of Minnesota, Court File No. 11-cv-820 (ADM/JSM)—Plaintiff *Jodi A. Schwendimann f/k/a Jodi A. Dalvey* v Defendant *Arkwright Advanced Coatings, Inc.* / Counterclaim Plaintiff—*Arkwright Advanced Coating, Inc.* v. Counterclaim Defendants *Jodi A. Schwendimann f/k/a/ Jodi A. Dalvey, and Cooler Concepts, Inc*.,—AACI'S Amended Prior Art Statement; AACI Amended Prior Art Chart-Exhibit A; AACI Prior Art Chart Exhibit B-Section 112 Invalidty Contentions; Office Action Oct. 4, 2012; U.S. Pat. No. 5,792,579.

* cited by examiner

INK-JET TRANSFER SYSTEM FOR DARK TEXTILE SUBSTRATES

TECHNICAL FIELD

The present invention relates to an ink-jet transfer system or an ink-jet transfer print.

BACKGROUND ART

Transfer prints enjoy a big popularity, as they allow the application of any graphic presentation, patterns, images or type faces, in particular on clothes like T-shirts, sweatshirts, shirts or also other textile substrates like for instance mousepads. Of particular interest are ink-jet transfer systems (ink-jet transfer prints), providing the potential users with the possibility of an individual selection of electronically processible and by means of graphic presentations which can be stored on a computer, and which can eventually be printed or ironed on, respectively, onto his desired garment or another textile substrate (support), respectively, by the user himself. Thereby, in a first step, the desired, electronically processible image is produced by the user of the transfer print by means of a computer, which is transmitted from the computer to a suitable printer, for example an ink-jet printer, which in turn prints the desired image onto the transfer system. The transfer print thus prepared has to display a structure which allows the further use for printing onto for example a textile substrate. By means of a suitable transfer print, the desired graphic presentation is brought to adhesion onto the desired textile substrate. Usually, graphic presentations are applied under supply of heat and pressure by a hot copy, and optionally by a prior cold copy onto the desired textile substrate.

In recent years, efforts have been undertaken in order to improve the hot transfer systems as well as to enable the printing of the desired graphic presentation onto the textile substrate with a satisfactory quality.

For instance, U.S. Pat. No. 5,242,739 describes a heat-sensitive transfer paper which is capable of receiving an image and comprises the following components: a) a flexible cellulose containing, unwoven, textile-like paper which has a superior and an inferior surface and b) a melting transfer-film layer which is capable of receiving an image, and which is situated onto the superior surface of the paper support, c) as well as optionally an intermediary hot-melt layer. The film layer is composed of about 15 to 80 weight-% of a film-forming binder and about 85 to about 20 weight-% of a powder like thermoplastic polymer, whereby the film-forming binder and the thermoplastic polymer have a melting point of between about 65° C. and 180° C.

U.S. Pat. No. 5,501,902 represents a further development of U.S. Pat. No. 5,242,739, which is composed of a two-layer system as well, whereby, however, for the improvement of the printing image, an ink viscosity agent is further contained. Furthermore, in the transfer print of U.S. Pat. No. 5,501,902, preferably a cationic, thermoplastic polymer is contained for the improvement of the ink-absorbing capacity.

As pigments for the receipt of the ink dyestuff, in the prior art, usually polyesters, polyethylene wax, ethylene-vinylacetate copolymers, and as a binder, polyacrylates, styrene-vinylacetate copolymers, nitrile rubber, polyvinylchloride, polyvinylacetate, ethylene acrylate copolymers and melamine resins are mentioned.

In WO 98/30749 (Océ-Switzerland) an ink-jet transfer system is described, which comprises a carrier material, a hot-melt layer being applied onto the carrier material and at least an ink-receiving layer. Thereby, the ink-receiving layer is a mixture of a highly porous pigment and a binder, whereby the molecules of the pigment and optionally of the binder as well as optionally of the hot-melt are capable of forming chemical bonds with the dyestuff molecules of the ink.

A special difficulty, however, is associated with transfer prints, which shall be applied onto a dark textile support. Since the dyestuffs are transparent against dark backgrounds, i.e. maximally perceptible as shadow, first of all a light contrast background has to be created to make the desired colored image better visible. According to the prior art, for this, in the course of a 2-step method or a one-step method, a transfer print is applied onto a dark piece of textile. In case of the conventional 2-step method, a white textile fabric equipped with a hot-melt adhesive on the back is laminated with a transfer foil that was imprinted by a xerographic method (or ink-jet) and then pressed with the hot-melt adhesive side on the dark garment to be imprinted (T-shirt) by means of a transfer press at ca. 180° C. and a pressure of about 7 bar. The image side with the thin foil (transfer layer) on it thereby is protected by a silicone paper. After the transfer operation that lasts about 10 seconds, the silicone paper is removed. The adhesion of the transfer print system on the dark garment is achieved by means of a polyethylene or polyester/polyamide textile adhesion (i.e. a hot-melt adhesive) of the contrast support on the textile substrate.

The whole system is felt to be unpractical by the user in so far as one needs a laminator and/or a textile transfer press for the realization of the method, whereby in particular the washproofness or the adhesion of the white contrast support on the dark piece of textile, respectively, still is particularly unsatisfactory and in addition is appreciably impaired with each washing.

The known systems that are usable by means of a one-step method are based on a white, thick transfer foil with a thickness of about 400 to 600 μm which can be imprinted by an ink-jet method or a xerographic method and subsequently transferred on a dark piece of textile by means of a transferred press. The disadvantages of this system are in particular the unsatisfactory image quality immediately after the transfer on the piece of textile. The images look faint and blurred. Furthermore, the whole system is comparatively thick, makes an unaesthetic impression (armor-like) and it is not breathable. An additional major disadvantage is the fact that the user who does not have available a transfer press and consequently switches to the use of a commercially available iron is confronted with a sustainably impaired adhesion of the transfer foil on the piece of textile. This loss of adhesion is further accelerated by repeated washings.

A further disadvantage of both conventional print systems is their application process on the textile substrate, whereby the application of a contrast background on the piece of textile under markedly high pressure cannot be performed by private persons without adequate equipment. The pressures of at least about 7 bar ($=7\times10^5$ Pa) often required for this can only be generated by a cost-intensive transfer press, whereby the users are mainly interested in a simple ironing on by means of a commercially available iron. The above mentioned disadvantages did significantly lead to the consequence that the currently sold transfer print systems did not become widely distributed in the market as desired, or were not very successful, respectively. On the contrary there still exists a great need for satisfactory systems that do not have the above-mentioned disadvantages.

DISCLOSURE OF THE INVENTION

Hence, it was one objective of the present invention to provide a textile transfer print system which at least partly avoids the above-mentioned disadvantages. In particular, a transfer print system for a dark textile support should be provided which on the one hand yields the desired high contrast, a high resolution, and on the other hand avoids the unsatisfactory washproofness due to insufficient adhesion of the transfer print on the textile support, and finally which can be applied on a piece of textile as uncomplicated and efficiently as possible i.e. in the course of a one-step method by means of an iron.

Furthermore, it was also an objective of the present invention to provide a method for the production of textile transfer print systems for dark textile substrates with high washproofness.

Finally, it was an objective of the present invention to provide a printing process, whereby by means of textile transfer print systems for dark textile substrates, graphic presentations with high quality or high washproofness, respectively, can be applied on textile substrates in a single step.

The above-mentioned objectives are resolved according to the independent claims. Preferred embodiments are mentioned in the dependent claims.

The ink-jet transfer system according to the present invention comprises or is composed of, respectively, a carrier material (base layer), an adhesive layer applied on the carrier material—preferably a hot-melt layer—which has dispersed spherical (globular) polyester particles of a granular size of less than 30 μm, a white background layer being applied on the adhesive layer and at least one ink-receiving layer being applied on the background layer. The white background layer which is found directly on the adhesive layer, according to the present invention, comprises or is composed of permanently elastic plastics which are non-fusible at ironing temperatures (i.e. up to about 220° C.) and which are filled with white pigments—also non-fusible (up to about 220° C.). The elastic plastics must not melt at ironing temperatures in order not to provide with the adhesive layer, e.g. the hot-melt, which provides the adhesion to the textile substrate, an undesired mixture with impaired (adhesive and covering) properties. Furthermore, the white background layer has to be elastic in order not to lead to a brittle fracture by subsequent mechanical stresses. Elasticity, in the sense of the present invention, means an expansion of at least 200%, preferably of between 500-1000% and in particular preferably of about 800%.

Preferred elastic plastics for the white background layer are selected from the group comprising the polyurethanes, polyacrylates or polyalkylenes or also natural rubber (latex), respectively. The most preferred elastic plastics contain or are composed of polyurethanes.

Suitable pigments are only those which do not melt at ironing on temperatures. The filled white layer or the polymers contained therein, respectively, such as e.g. polyurethane must not melt, because otherwise the white pigments would sink or penetrate, respectively, into the textile substrate. Associated with this would be a reduction or even a destruction, respectively, of the white background color which according to the invention shall be provided to provide a background for dark prints. Particularly preferred white pigments are inorganic pigments selected from the group comprising $BaSO_4$, ZnS, $TiO_2$, ZnO, SbO. Also organic pigments are usable for the white background layer as long as they are non-fusible at ironing on temperatures. These pigments can be blended alone or also in a mixture with other non-fusible (up to 220° C.) carrier agents such as for example silicates or aluminates.

Thus, the present invention succeeds in providing a transfer system which has a white background layer in the print system itself, i.e. between the adhesive layer and the ink-receiving layer, whereby the entire system, in spite of the non-fusible white background layer, surprisingly fulfills the following requirements:

a) All of the 4 chemically different layers are compatible, in particular chemically, in the course of the coating process, as well as the melting process (the ironing onto the textile substrate). There occurs no beading or detachment, respectively, of the white background layer from the adhesive layer and/or the ink-receiving layer from the white background layer.

b) The 4 chemically different layers furthermore show a good adhesion to each other after production of the transfer system so that there is no splintering off or detachment, respectively, of single layers of the transfer system that is ironed on the textile substrate.

c) The transfer system shows also an excellent adhesion and elasticity on the textile substrate, particularly after ironing on the textile substrate. Said elasticity is of great importance since the ironed-on transfer system should not become brittle and should not effect a sustainable impairment of the graphic presentation on the textile substrate. Particularly in case of sports stresses (e.g. pulling at or crumpling of the T-shirt, respectively) the image imprinted on the textile support has to adhere tightly.

d) Finally, the inventive transfer system is washable as a composite on the textile substrate without adversely affecting the color fastness as well as the adhesion on the textile substrate.

The glued lamellar structure is in a way a sandwich structure in which the white background layer is glued to the textile substrate, whereby no mixing of the background layer with the adhesive layer, e.g. a hot-melt layer, by a melting process is possible and the entire system is nevertheless flexible enough that the graphic presentation printed on the ink-receiving layer cannot be detached by mechanical stresses.

The adhesive layer has to be essentially or completely fusible and must only be adhesive in a fused condition. In a very particularly preferred embodiment, the adhesive layer which is found directly on the carrier material is a pure hot-melt layer. The hot-melt layer is essentially a wax-like polymer which is easily fusible and thus can for example be transferred onto the textile substrate together with the imprinted ink-receiving layer by ironing on. Due to its wax-like properties, the hot-melt layer primarily effects the adhesion to the textile substrate. On the other hand, the hot-melt layer also has to mediate a good adhesion to the white background layer which is chemically totally different (not wax-like, nonfusible). This is inventively achieved in that in the hot-melt layer, very small spherical polyester particles of a granular size of less than 30 μm are dispersed. These spherical polyester particles in turn are chemically more related to the white background layer (than the pure hot-melt wax components) so that during melting they can form or enhance, respectively, the adhesion to the white background layer. A particle size of less than 30 μm is required so that the particles do not bulge out from the layer and thus cause problems during coating. The spherical polyester particles are preferably obtained for example by stirring in cryo-ground polyester together with the wax-like hot-melt compounds during the production of a dispersion and melting small drops of up to 30 μm (emulsion). After the cooling, the drops solidify and small beads develop, i.e., a dispersion. A preferred hot-melt compound is for example an ethylene acrylic acid copolymer or a PU dispersion. Together with the spherical polyester particles of a granular size of less than 30 μm, said compound is processed to a hot-melt layer dispersion.

As adhesive layer, besides a pure hot-melt, also a hot-melt adhesive dissolved in a solvent can be used. For example a solvent-containing adhesive based on polyamides or polyethylenes which on the one hand effects a good adhesion to the textile substrate and on the other hand to the white background layer are suitable for the realization of the present invention.

In a preferred embodiment, the adhesive layer, however, contains or is composed of a pure hot-melt since said hot-melt forms the desired adhesion to the white background layer and to the textile substrate by means of a comparatively simple external controlling means, i.e. by means of ironing on, in a convenient but efficient manner.

The ink-receiving layer (ink layer) is situated on the white background layer and primarily comprises a highly porous pigment and a binder. The highly porous pigment provides on the one hand a purely mechanical uptake of the ink during printing of the desired graphic presentation whereby a maximal porosity ensures an especially high absorbability. Binders are necessary to bind the highly porous pigments on the product surface to allow the processing (imprinting) of the ink-jet transfer system.

In principle, all known, mainly highly porous pigments are suitable as ink-receiving layer for the purposes of the present invention: Examples are polyesters, PE-wax, PE-powders, ethylene-VAC copolymers, nylon, epoxy compounds. Suitable as binders are polyacrylates, styrenebutadiene copolymers, ethylene-VAC copolymers, nylon, nitrile rubber, PVC, PVAC, ethylene-acrylate-copolymers.

Preferably the at least one ink-receiving layer comprises a mixture of a highly porous pigment and a binder whereby more preferably the molecules of the highly porous pigment and optionally of the binder and optionally of the adhesive layer, e.g. the hot-melt layer, are capable of forming essentially covalent bonds to the dyestuff molecules of the ink. This has the advantage that the respective dyestuffs, after printing on the textile substrate, for instance by ironing on, are no longer primarily mechanically bonded, but as a result of—essentially covalent—bonds are chemically bonded to the molecules of the pigment and of the binder and optionally of the hot-melt. This is achieved in that the molecules of the pigment and optionally of the binder and optionally of the hot-melt have available reactive groups that are capable of forming covalent bonds to the also reactive groups of the dyestuff molecules of the ink.

The essentially covalent bonds between the dyestuff molecules of the ink and the molecules of the pigment as well as of the binder are, among others, formed upon providing energy, for instance by ironing on (at about 190° C.) the inventive ink-jet transfer system on the textile substrate.

For the printing of the ink-jet transfer system, for instance by means of an ink-jet printer, in the market, usually acid dyestuffs are used in printer inks, for example azo-dyestuffs according to formula I.

(I)

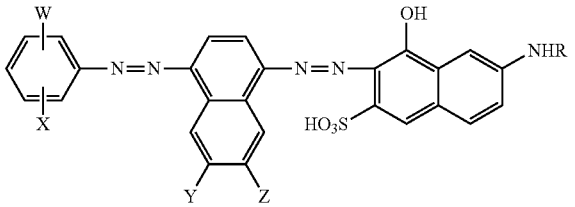

W = COOH
X = H or COOH
Y & Z = H, COOH or $SO_3H$
R = H, $CH_2COOH$ or $CH_2CH_2COOH$

The molecules of the ink dyestuffs are primarily present as anions in solution and also have available reactive groups which allow the formation of chemical bonds to the reactive groups of the pigment molecules as well as optionally the binder molecules. The reactive groups are usually one or more sulfonate groups or carboxylate groups per dyestuff molecule. Under suitable conditions, for instance through heating during the ironing on of the ink-jet transfer system onto the textile substrate, covalent or also rather ionic bonds or intermediary valence bonds, respectively, can be formed between said sulfonate groups or carboxylate groups, respectively, and the reactive groups, for example amino groups, of the pigment or binder, respectively. But in particular, the covalent bonds of the dyestuff molecules to the molecules of the ink-receiving layer, with formation of e.g. sulfonamides (—$SO_2$NH—R) or amide groups (—CONH—R), respectively, (besides rather amphoteric $SO_3^-$ $NH_3^+$—R groups) are particularly preferred.

As an example, the poly[1,2-bis(aminomethylcyclohexyl) ethane-adipic acid amide] of the formula (II) is mentioned which generates essentially covalent bonds (sulfonamide groups or acid amide groups, respectively) with its terminal amino groups upon reacting with the acid groups of an azo-dyestuff.

(II)

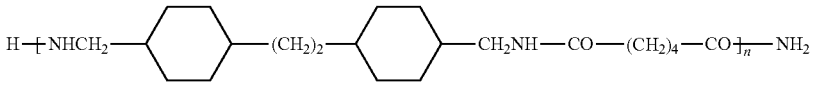

MODES FOR CARRYING OUT THE INVENTION

In a preferred embodiment, the ink-receiving layer of the inventive ink-jet transfer system is composed of a highly porous pigment and a binder, whereby at least one of the two components, in particular the pigment being present in bigger amounts has available reactive amino groups that are capable of forming essentially covalent bonds to the dyestuff molecules of the liquid ink.

In a particularly preferred embodiment of the present invention, the ink-receiving layer comprises a highly porous polyamide pigment and a binder composed of a soluble polyamide, whereby the terminal, free amino groups of the polyamide pigment and of the polyamide binder are capable of fixing reactive groups, for example sulfonate groups or carboxylate groups of the dyestuff molecules. Because of that, with the pigment component as well as the binder component, a chemical fixation of the dyestuff molecules can be achieved.

Besides the inventive requirement of the capability of the formation of essentially covalent bonds between the dyestuff molecules of the ink and the molecules of the pigment as well as the binder, the ink-jet transfer system according to the present invention has to have a high absorption capacity or uptake, respectively, of ink in order to guarantee a clear print image. This requirement is achieved by providing a pigment, preferably a polyamide pigment with a high porosity.

Preferred polyamide pigments which are used for the ink-jet transfer systems according to the present invention preferably display a spherical, for instance a globular geometry and an interior surface which is as high as possible. The granular sizes of the used polyamide pigments are in a range of about 2 μm and about 45 μm, whereby a range of 2 to 10 μm is particularly preferred. The bigger the granular size of the polyamide pigments, the more the surface of said pigments is closed and thus the ink-receiving capacity is reduced or even rendered impossible, respectively. The interior surface of the highly porous pigment amounts to at least about 15 $m^2/g$; preferably it is between about 20-30 $m^2/g$.

It turned out that in particular a polyamide pigment with the trade name "Orgasol" displays the required properties, in particular the high-grade porosity.

A highly porous polyamide pigment with an interior surface of at least about 15 $m^2/g$ and a granular size of about 2 μm and about 45 μm is obtained by means of an anionic polyaddition and a subsequent controlled precipitation process. In contrast to the conventional production methods in which a polyamide condensation product, for example as a granulate, is prepared, which is then milled, the polyamide pigments are actually grown and the growth of the pigments is ceased upon reaching the desired granular size. 85-95% of the polyamide pigments thus obtained show the desired form and granular size, whereby only maximally 15% have a smaller or bigger granular size.

For an ink-receiving layer with highly porous polyamides being used as pigments, the binder preferably is composed of a polyamide as well. The polyamide used as a binder is different concerning its properties from the polyamide pigment insofar as it is employed as a solution and thus does not have to comply with specific form requirements. The use of polyamide as a binder is therefore less critical. It has only to be soluble in a suitable solvent, for instance alcohol or a alcohol-water mixture, respectively, and preferably has available free terminal amino groups by means of which dyestuff molecules, for example sulfonate groups of azo-dyestuffs or ester groups can be fixed.

The ratio of the highly porous pigment and the binder in the ink-receiving layer of the inventive ink-jet transfer system amounts to between about 5:1 and 1:1, preferably 3:1 and 2:1 and very much preferred 2.4:1.

The hot-melt layer which is preferably used in the ink-jet transfer system according to the present invention as adhesive layer is found directly on the removable carrier material and serves to transfer the graphic presentation imprinted by the ink-jet printer on the textile substrate and to ensure an adhesion to the white background layer. Said transfer is, for instance, effected by a cold copy, i.e. by ironing on, cooling down and removing the carrier layer (baking paper). During the ironing on, the hot-melt layer and the ink-jet receiving layer, but not the white background layer are molten. This way, the image imprinted on the ink-receiving layer is transferred on the textile substrate without any fusing-associated distortions.

The hot-melt preferably used as adhesive layer in contrast to the highly porous pigment, binder as well as the background layer, is essentially wax-like, i.e. it can be fused. Usually, hot-melts melt in a range of about 100-120° C. while the highly porous pigments preferably melt in a range of 120-180° C., preferably 140-160° C. A usual hot-melt is for instance an ethylene acrylic acid copolymer dispersion.

Further additives can be contained in the ink-jet transfer system according to the present invention, however, upon the use of such additives, it has to be paid attention that their use does not impair the washproofness of the eventually obtained transfer print. Because of process-technology reasons, for instance, it is reasonable to use a dispersing additive for organic pigments in the preparation of the inventive ink-jet transfer system.

As a support (cover layer) for the cold copy, nearly any separating paper can be used, preferably a heat-resisting paper, for example a silicone paper is used.

Besides the ink-jet transfer system itself, an additional aspect of the present invention is a method for its preparation. The coating method comprises the following steps:

a) application of an adhesive layer, preferably a hot-melt layer, which has dispersed spherical polyester particles of a granular size of less than 30 μm onto a carrier material, for instance silicone paper, by means of a coating means for instance a coating machine, whereby a layer thickness of about 30 to 40 μm is adjusted, thereafter drying the hot-melt layer, and b) application of a white background layer composed of elastic plastics which are non-fusible at ironing on temperatures (i.e. up to about 220° C.), and which are filled with white, preferably inorganic, pigments onto the hot-melt layer, preferably with a resulting layer thickness of about 20-35 μm, c) application of at least one ink-receiving layer dispersion onto the white background layer, and d) drying the ink-jet transfer system.

The double/multiple application of the ink-receiving layer according to step c) provides the advantage that a smooth and even surface as well as an ink-receiving layer with a balanced thickness is formed, whereby the printing process or the resulting print image, respectively, is influenced in a positive way.

First, the graphic presentation to be applied onto the textile substrate is laterally correctly printed onto the ink-jet transfer system thus obtained by a usual printer, e.g. an ink-jet printer (ink-jet-plotter), cut out, removed from the support (e.g. silicone paper), covered with baking paper and afterwards ironed onto the desired textile substrate, for instance a T-shirt, at a temperature of between about 160 and 220° C., preferably of 170° C., during at least 10 seconds. The lowest layer is the carrier material which is removed and discarded before the application of the graphic presentation. As the preferred cover paper, a heat-resistant silicone paper (baking paper) is used. The printed graphic presentation obtained in such a way (cold copy) is smooth and faint.

In the following, the present invention shall be illustrated by two examples whereby the examples are not to be construed as limiting the scope of protection.

Example 1

Preparation of an Ink-Jet Transfer System

In a first step, the hot-melt layer is applied onto a carrier material: Thereby, a silicone paper of a layer thickness of about 0.1 mm is coated with an ethylene acrylic acid copolymer containing dispersed spherical polyester particles of a granular size of between 5-25 μm. The ratio of ethylene acrylic acid copolymer and spherical polyester particles is about 60:40 and the resulting layer thickness of the hot-melt layer is about 30 μm.

Subsequently, a white background layer (polyurethane foil) with a thickness of about 40 μm containing about 15 weight-% $TiO_2$ is applied onto the silicone paper coated with the hot-melt.

On said elastic background layer of polyurethane/$TiO_2$ a dispersion containing the ink-receiving layer is applied in two steps. In the first step, a layer thickness of 15 μm is applied and in the second step, a layer thickness of 15 μm is applied, whereby a total layer thickness of the ink-receiving layer of 30 μm results.

The ink-receiving layer was previously prepared as follows: an ethanol/water mixture in the ratio of 3:1 is placed in a vessel and a soluble polyamide binder is dissolved therein under heating to 45° C. Afterwards the highly porous polyamide pigment "Orgasol 3501 EX D NAT1" with a granular size of 10 μm as well as an interior surface of about 25 $m^2/g$ pigment is dispersed in the solution.

In order to stabilize the dispersion, a dispersing additive for organic pigments commercialized by the Company Coatex with the product designation COADIS 123K is introduced and the dispersion is stirred during 10 minutes at room temperature.

On the coating machine, the solvent is allowed to evaporate in order to obtain a solid ink-receiving layer on which the desired graphic presentation can be printed by means of an ink-jet printer.

The desired foils can be cut arbitrarily according to the required needs.

Example 2

Use of an Ink-Jet Transfer System for Printing

The ink-jet transfer system prepared in example 1 is used in order to print a graphic presentation on a T-shirt. Thereby, in a first step, the desired electronically processible and stored graphic presentation is printed by a computer by means of an ink-jet printer in a laterally correct way onto the sheet which has been obtained as the ink-jet transfer system in example 1.

Afterwards, the print is removed and put with the white side onto the desired side of the selected T-shirt and ironed on by means of a hot iron (baking paper+temperature of about 190° C.) during 10 seconds. Afterwards, the T-shirt thus processed is cooled down to about room temperature and the baking paper, i.e. the silicone paper is removed. The image thus obtained is shining and matt.

While in the present invention, preferred embodiments of the invention are described, it has clearly to be pointed out that the invention is not limited thereto and may be otherwise practiced in the scope of the following claims.

What is claimed is:

1. An article for imparting an image to a dark-colored receiving member, comprising:

a carrier paper including a release enhancing coating; and one or more layers overlaying the release-enhancing coating, the one or more layers comprising an ink receptive layer, at least one polymer layer, and a white pigment;

wherein the ink receptive layer is effective for receiving indicia; and wherein one of said polymer layers comprises a background layer including a polymer and a concentration and configuration of the white pigment sufficient to provide a substantially opaque background for the received indicia, the polymer being non-fusible at temperatures up to about 220° C.

2. The article of claim 1, wherein the at least one polymer layer further includes a hot-melt adhesive layer which is disposed between the release-enhancing coating and the ink receptive layer.

3. The article of claim 1, wherein the ink receptive layer includes polyamide.

4. The article of claim 2, wherein the hot melt adhesive layer comprises LDPE, EAA, or polyamide.

5. The article of claim 1, wherein the carrier paper is peelable away from the ink receptive layer and the at least one polymer layer along a portion of the release-enhancing coating.

6. An article for transferring an image to a fabric material, comprising:

a removable carrier member;

a substantially opaque white layer overlaying a portion of the carrier member, the opaque white layer having a melting range not within hand iron pressing temperatures and including a binder and a white pigment; and at least one ink-receptive layer overlaying the opaque white layer, the at least one ink-receptive layer including a binder and a polymeric material;

wherein the at least one ink-receptive layer includes a first ink-receptive layer and a second ink-receptive layer.

7. The article of claim 6, wherein the at least one ink-receptive layer includes a melting temperature within a range of about 120° C. to about 180° C.

8. The article of claim 6, wherein the carrier member is coated with a release-enhancing coating.

9. The article of claim 8, wherein the release-enhancing coating comprises silicone.

10. An article for imparting an image to a receiving member, comprising:

a carrier member;

a substantially opaque first layer overlaying the carrier member, the opaque first layer including a white pigment and wherein the substantially opaque first layer is non-fusible up to about 220° C.; and a second layer overlaying the opaque first layer and configured to receive indicia, the second layer including a polymeric material.

11. The article of claim 10, wherein the substantially opaque first layer includes a concentration and configuration of the white pigment sufficient to provide a substantially white background to received indicia.

12. The article of claim 10, wherein the second layer is an ink-receptive layer.

13. The article of claim 11, wherein the received indicia is applied using an ink jet printer.

14. The article of claim 10, further comprising a hot-melt third layer disposed between the carrier material and the opaque first layer.

15. The article of claim 14, wherein the third layer comprises at least one of polyethylene, or ethylene acrylic acid.

16. The article of claim 10, wherein at least one of the opaque first layer or the second layer includes a binder.

17. The article of claim 10, wherein the opaque first layer includes a melt temperature not within hand iron pressing temperatures.

18. The article of claim 10, wherein the white pigment comprises at least one of zinc oxide, zinc sulfate, barium sulfate, or titanium oxide.

19. The article of claim 10, wherein the polymeric material of the second layer includes a polyamide.

* * * * *